United States Patent [19]

Seroka et al.

[11] Patent Number: 4,755,011

[45] Date of Patent: Jul. 5, 1988

[54] CONTAINER FOR RECEIVING CURRENCY BILLS

[75] Inventors: Karl-Heinz Seroka, Salzkotten; Hubert Rittmeister, Salzkotten-Thuele, both of Fed. Rep. of Germany

[73] Assignee: Nixdorf Computer AG, Paderborn, Fed. Rep. of Germany

[21] Appl. No.: 714,951

[22] Filed: Mar. 22, 1985

[30] Foreign Application Priority Data

Apr. 3, 1984 [DE] Fed. Rep. of Germany ..... 3412424

[51] Int. Cl.[4] ..... A47B 51/00

[52] U.S. Cl. ..... 312/312; 109/47; 109/73; 220/345; 312/220; 312/297

[58] Field of Search ..... 109/66, 73, 49, 53, 109/45, 47; 220/345, 350; 108/145, 147; 312/297, 312, 19, 244, 184, 333, 301, 220, 221

[56] References Cited

U.S. PATENT DOCUMENTS

| | | | |
|---|---|---|---|
| 1,740,888 | 12/1929 | Davidson | 312/297 X |
| 2,049,969 | 8/1936 | Meunier et al. | 109/73 |
| 2,330,670 | 9/1943 | Black | 312/297 X |
| 2,917,354 | 12/1959 | Natke | 312/312 X |
| 3,216,773 | 11/1965 | Martin et al. | 312/19 |
| 4,022,137 | 5/1977 | Chiu | 109/47 X |
| 4,082,390 | 4/1978 | Gibson et al. | 312/244 X |
| 4,235,491 | 11/1980 | Korber et al. | 312/297 X |
| 4,551,194 | 4/1985 | Park et al. | 312/312 X |
| 4,589,708 | 5/1986 | Kokubo et al. | 312/312 X |

FOREIGN PATENT DOCUMENTS

| | | | |
|---|---|---|---|
| 193101 | 1/1957 | Austria | 108/145 |
| 49533 | 4/1982 | European Pat. Off. | 109/73 |
| 503928 | 12/1954 | Italy | 312/297 |
| A2066161 | 7/1981 | United Kingdom | 184/ |

OTHER PUBLICATIONS

U.S. patent application Ser. No. 323,734 dated 4/1943 by Becker.

*Primary Examiner*—Peter A. Aschenbrenner
*Assistant Examiner*—Thomas A. Rendos
*Attorney, Agent, or Firm*—Cullen, Sloman, Cantor, Grauer, Scott & Rutherford

[57] ABSTRACT

A container for receiving currency bills or the like includes a plurality of adjacent compartments (22) and a housing (12) enclosing these with a closure unit (18) which is designed for selectively unblocking a predetermined compartment opening. The compartments are made up of individual compartment receptacles (22) which are arranged to be movable in the housing (12) parallel to the direction in which the compartment opening points and to which a positioning device (136) is assigned, through which respectively one compartment receptacle (22) can be moved between a waiting position, in which it is completely inside the housing (12), and an access position in which it partially protrudes out of the opening which is unblocked by the closure unit and substantially corresponds to the cross section of the compartment receptacle (22).

16 Claims, 6 Drawing Sheets

CONTAINER FOR RECEIVING CURRENCY BILLS

DESCRIPTION

1. Technical Field

The invention relates to a container for receiving currency bills or the like, including a plurality of compartments arranged one beside another and a housing enclosing these with a closure unit which is designed for the selective release of a predetermined compartment opening.

2. Background of the Invention

Security considerations in banks have led to the requirement that no bills be kept in the counter area with free access. This has already led to the development of cash strongboxes which on the control command of an operator will receive and dispense currency bills. This, however, involves expensive equipment, which is not worthwhile for the ordinary branch banks which are not definitely prepared for the exchange of foreign currency, but only for the national currency. On the other hand, even such branch banks have to keep ready at least certain reserves of bills of different currency.

A container of the type mentioned at the start is already known in which the compartments are arranged radially around a central axis on a support which is pivoted in a cylindrical housing, so that the compartments can be moved past an opening provided in the cylinder wall. With a suitable dimensioning of the wall opening and of the compartments, two compartments at most are accessible in the best case with this device. However, its operation is relatively inconvenient since the compartment's contents cannot readily be seen and as a rule the whole sheaf of bills contained in one compartment must be taken out in order to pay out a certain number of bills.

SUMMARY OF THE INVENTION

The invention is based on the problem of supplying a container of the type mentioned at the outset which is simple to operate and nonetheless offers the maximum degree of security.

This problem is solved according to the invention by having the compartments made up of individual compartment receptacles which are arranged to be movable parallel to the direction in which the compartment points, in the housing, and in that the compartment receptacles have a positioning device assigned to them by which respectively a compartment receptacle can be moved between a waiting position in which it is located entirely inside the housing and an access position in which it partially protrudes out of the opening which is released by the closure unit and corresponds substantially to the cross section of the compartment receptacle.

The container according to the invention, like the known container described above, is relatively simple in construction, at least in comparison with a cash strongbox, since it requires no expensive separating and conveying devices for the bills. The container according to the invention can be fully closed, so that no access is possible to any of the compartments. If access to one of the compartments is wished, the related compartment receptacle can be lifted up out of the unblocked opening so that a viewing of the amount of bills contained in the compartment as well as the removal or putting in of a desired amount of bills is extremely simple. At the same time, by means of the compartment receptacle partly protruding out of the opening, the opening is closed in such a way that access to the interior of the housing is prevented.

Preferably the compartment receptacle is vertically shiftable, for which it is then sufficient to design the positioning device as a lifter device, since the container returns to its waiting position by reason of the force of gravity alone. In order to facilitate this it is expedient to have at least two opposite walls of the compartment receptacle, which is usually box-like and with its side walls adjacent to one another, turned obliquely downward toward one another, so that the compartment receptacle can slide back into the housing by reason of the force of gravity without hooking or jamming. Preferably the compartment receptacles are arranged in a case which can be taken out of the housing and which shows an access opening for the positioning device. Thus, at the close of business the compartment receptacle can be taken out of the container and kept in the central safe. Moreover, in this way it is made easier to have ready an always full reserve of bills of certain currencies. In order therewith to exclude any manipulation and prevent access to the compartment receptacles by unauthorized persons, it can be provided that the case can be retained on the container and shows a cover lockable with it, where the locking of the cover is releasable only after the retaining of the case in the container and the case can be removed from the container only with the locked cover. Thus, the case can be transported outside of the container only in a closed and locked state.

In order to keep the construction expense as low as possible, it is suitable for the positioning device to be arranged on a carriage which can be moved in the housing relative to the compartment receptacles by means of a positioning drive. Therefore one positioning device is sufficient for the whole of the compartment receptacles. The positioning drive may include an electric motor and a coding ruler integral with the housing with coded openings which can be scanned by means of an optoelectronic scanning device. Therewith the positioning device can be positioned precisely in a position corresponding to a certain compartment receptacle which position is also electronically controllable.

Preferably the lifter device is made in the form of a lifter scissors with two crossed scissor arms which are hinged on each other and which by their free ends are intended to be supported in a sliding manner on the bottom of a compartment receptacle, while the one scissor arm is hinged by its second end on the carriage and the other scissor arm is connected by its second end with a servomotor. This lifter device is simple in construction and has the advantage that with a slight positioning movement of the servomotor, a relatively large lifting height can be achieved with a suitable length of the scissor arms. Besides this, neither the lifter device nor the compartment receptacle need be constructed for any special conveying action. It is sufficient to move the lifter device under the respective compartment receptacle and to swing the scissors arms, whereby the compartment receptacle to be lifted, which is moved laterally between the adjacent compartment receptacles, is lifted up.

Preferably the positioning device and the closure device are electronically controllable, and their operation can be coupled in such a way that when a suitable signal is initiated, first the opening assigned to the respective compartment receptacle is unblocked and then the compartment receptacle is lifted up.

According to a preferred embodiment, the closure unit is formed by a jalousie closure including a plurality of plates joined with one another, the ends of such plates being guided on the container housing, as well as a drive mechanism for opening and closing the jalousie. In order to be able to release a compartment opening at a prescribed position and only at this position, with a closure of this type, according to the invention the drive mechanism acts on an end plate, where each plate is releasably joined with the plates adjacent to it and a control mechanism is provided for the operative release of the union of two plates.

If the union between two adjacent plates is released, then when the drive mechanism is operated, only the segment of the jalousie joined with this moves, while the uncoupled segment of the jalousie remains where it is. In this way an opening is formed between the two selected uncoupled plates, the width of which depends on the path of motion of the jalousie segment joined with the drive mechanism. As can easily be seen, this opening can be formed at any desired positions of the jalousie by uncoupling the adjacent plates at the position in question. The path of motion of the jalousie segment joined with the drive mechanism for unblocking the partial opening here is entirely independent of where the partial opening is or the number of jalousie segments that must be displaced in order to unblock a partial opening of any desired width, while the remainder of the opening remains closed.

According to a preferred simple embodiment, at least one hook-shaped connecting element is arranged hinged on each plate (except an end plate) and comes into contact with a counter-element formed on the respective adjacent plate and by means of the control mechanism can be swung into its unblocking position. Preferably the connecting element in its contact position is under initial stress by a restoring spring, where moreover it is provided with a guiding surface for the automatic catching of the counter-element of the respective adjacent plate. In this way the two jalousie segments need only be pushed together again in order to close the partial opening so that the connecting element catches in the corresponding counter-element of the adjacent plate. A particularly simple solution is given when the hook-shaped connecting elements are each pivoted on the end faces of the plates around axes parallel to the lengthwise direction of the plates and the counter-element is formed respectively by a pin likewise arranged on the end face of the respective adjacent plate. When the plates are provided on their end faces with rollers, the roller spindles can each be used as a counter-element.

In order to be able to uncouple two plates of the jalousie at a desired position, it is proposed according to the invention that the control mechanism be movable perpendicularly to the lengthwise direction of the plates and parallel to the jalousie plane and show at least one control lever for swinging the connecting element into its unblocking position. In this way, it is possible to unblock a partial opening at any desired position without any action from the outside preferably the control lever is movable by an electromagnet into its working position against the action of a restoring spring.

The control lever is preferably supported movably on the carriage carrying the positioning device in a straight line substantially perpendicularly to the jalousie plane, where the control lever at its free end shows a catch which in the operating position of the control lever grasps an extension on the connecting element. The control mechanism is thus moved by means of the carriage up to the level of the plate on which the connecting element is to be swung into its unblocking position. After this position is reached, the control lever is moved and thereby the connecting element is swung.

For the case where the partial opening need only be relatively narrow and thus the jalousie segment connected with the drive mechanism need only be moved a short way, it is proposed according to the invention that the drive mechanism acting on an end plate of the jalousie comprise a crank pivoted rotationally integral around a first stationary spindle and drivable by a servomotor as well as a two-armed lever which is pivoted around a second stationary spindle and is hinged by its one end on the end plate and by its other end is connected with the crank by way of a double link, where the end plate with its end roller is guided in a rail fitting the motion of the two-armed lever. This drive makes possible a forced motion in both directions of the jalousie segment connected with the drive mechanism. Preferably for this the positioning motor is controlled in such a way that the crank respectively executes a half revolution for the opening and closing motion of the jalousie. With the drive mechanism described above this makes possible a movement of the jalousie in both directions with a constant rotational speed of the servomotor. This simplifies the control of the servomotor. The controlling of the servomotor for a rotary motion of the crank in steps of 180° each can be achieved in a simple way by arranging at least one disk cam on a spindle which is joined rotationally integral with the crank and is rotatable by the servomotor, which cam interacts with a switch to control the servomotor.

It is seen that with a suitable choice of the plate width, the opening corresponding to the width of a compartment receptacle can be accurately unblocked. If the compartment receptacle is raised by the lifter device, then it protrudes upward out of the container through the opening unblocked by the jalousie, while at the same time it closes the jalousie opening and thus reliably prevents any access to the other compartment receptacles. The opening and closing of the closure occurs relatively quickly, since the jalousie segment joined with the drive mechanism always need be pushed only a relatively short distance regardless of the location of the respective partial opening. After this the compartment receptacle located under the respective unblocked opening must be raised.

Further features and advantages of the invention follow from the following description, which in combination with the annexed drawings will explain the invention on the basis of an embodiment example. In these:

DETAILED DESCRIPTION OF ILLUSTRATIVE EMBODIMENT

Figure 1:
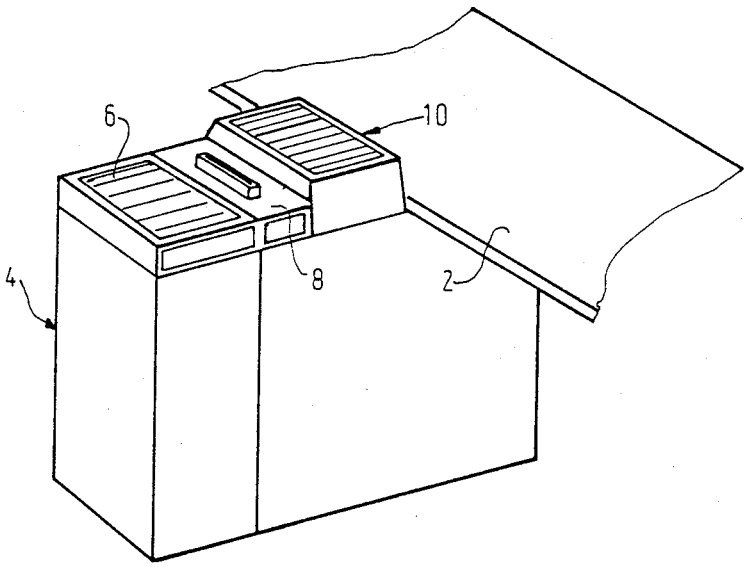
FIG. 1 shows a perspective view of a diagrammatically represented modular self-contained cash strongbox with a container according to the invention.
Figure 7:
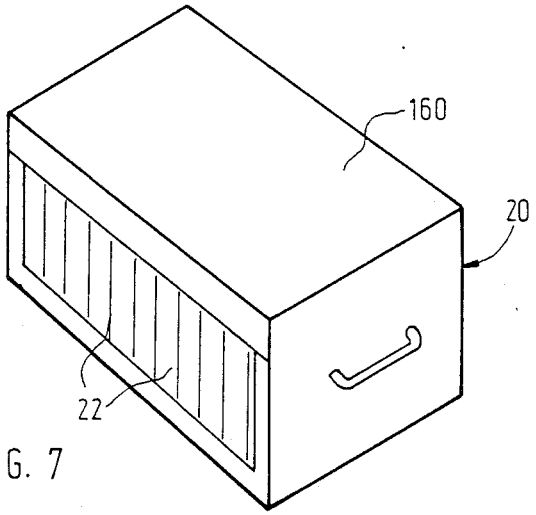
FIG. 7 shows a perspective view of the case containing the compartment receptacle with cover.

In FIG. 1 is denoted a bank counter 2 on which a cash strongbox 4 stands on the operator's side. This includes an input unit 6 for bills received, an output unit 8 for bills to be given out and a sorting receptacle 10 which will be described in detail in the following.

Figure 2:
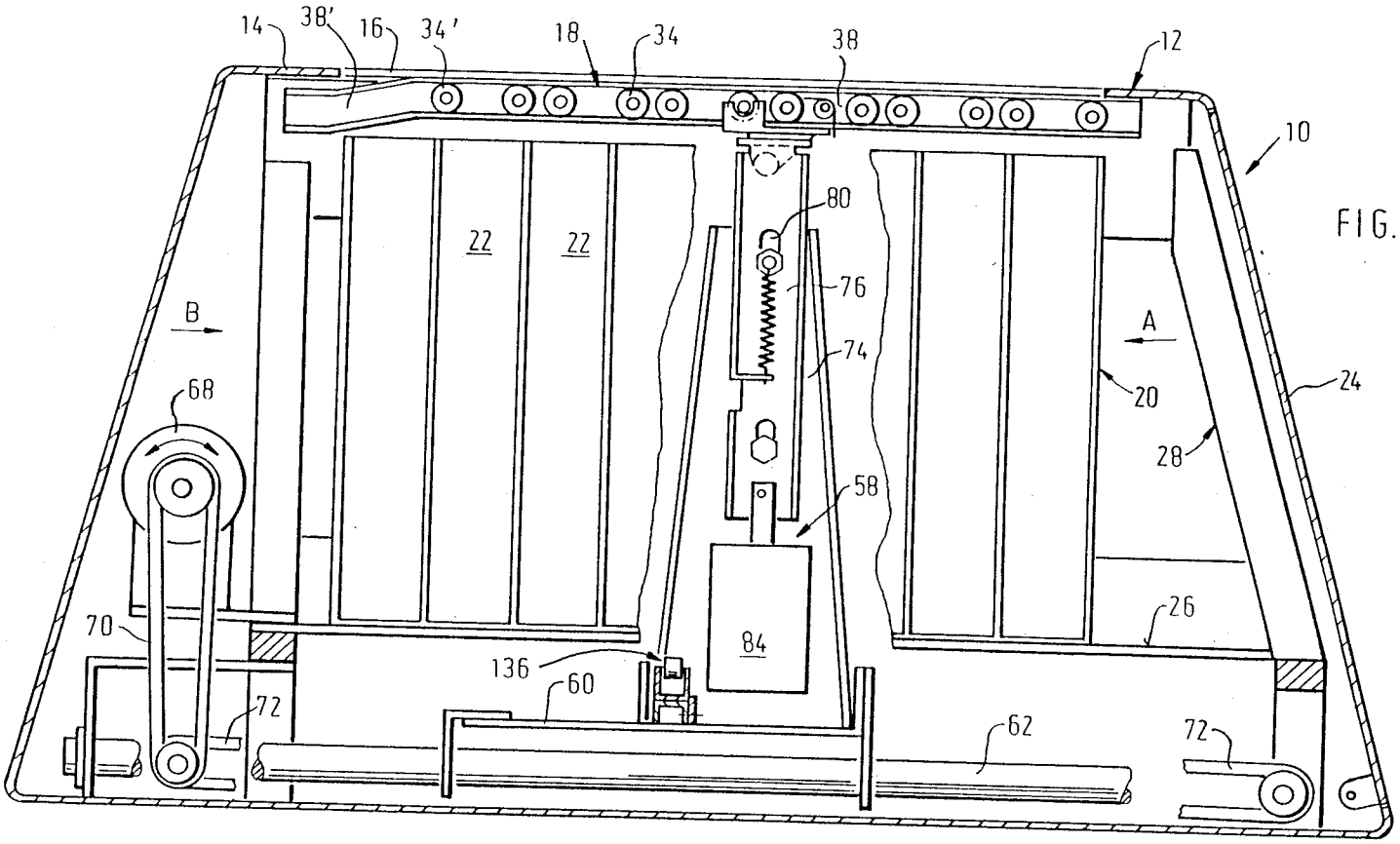
FIG. 2 shows a partly diagrammatic section through a container provided with the jalousie closure according to the invention which section is perpendicular to the lengthwise direction of the plates.

In FIG. 2 is seen the container designated in general as 10 with a housing 12 which on its covering face 14 shows an opening 16 which can be closed off with the jalousie 18 according to the invention. The container 10 serves for receiving a slide-in unit 20 with individual compartments 22 which are open on their top end and serve for receiving bills. The slide-in unit 20 is pushed in by a swingable housing flap 24 on V guides 26 of a container frame 28 arranged inside the housing 12, which frame is represented and described only insofar as is required for describing the support and control of the jalousie 18. The container 10 in the present case is to be used for example for keeping bills at a bank counter, for which the jalousie 18 is constructed so that it unblocks access to the compartment 22 only. It is not possible to unblock all of the compartments 22 to access at the same time other than by opening the closable lid 24. The construction and operation of the jalousie 18 which fulfills this task will now be explained in the following.

Figure 3:
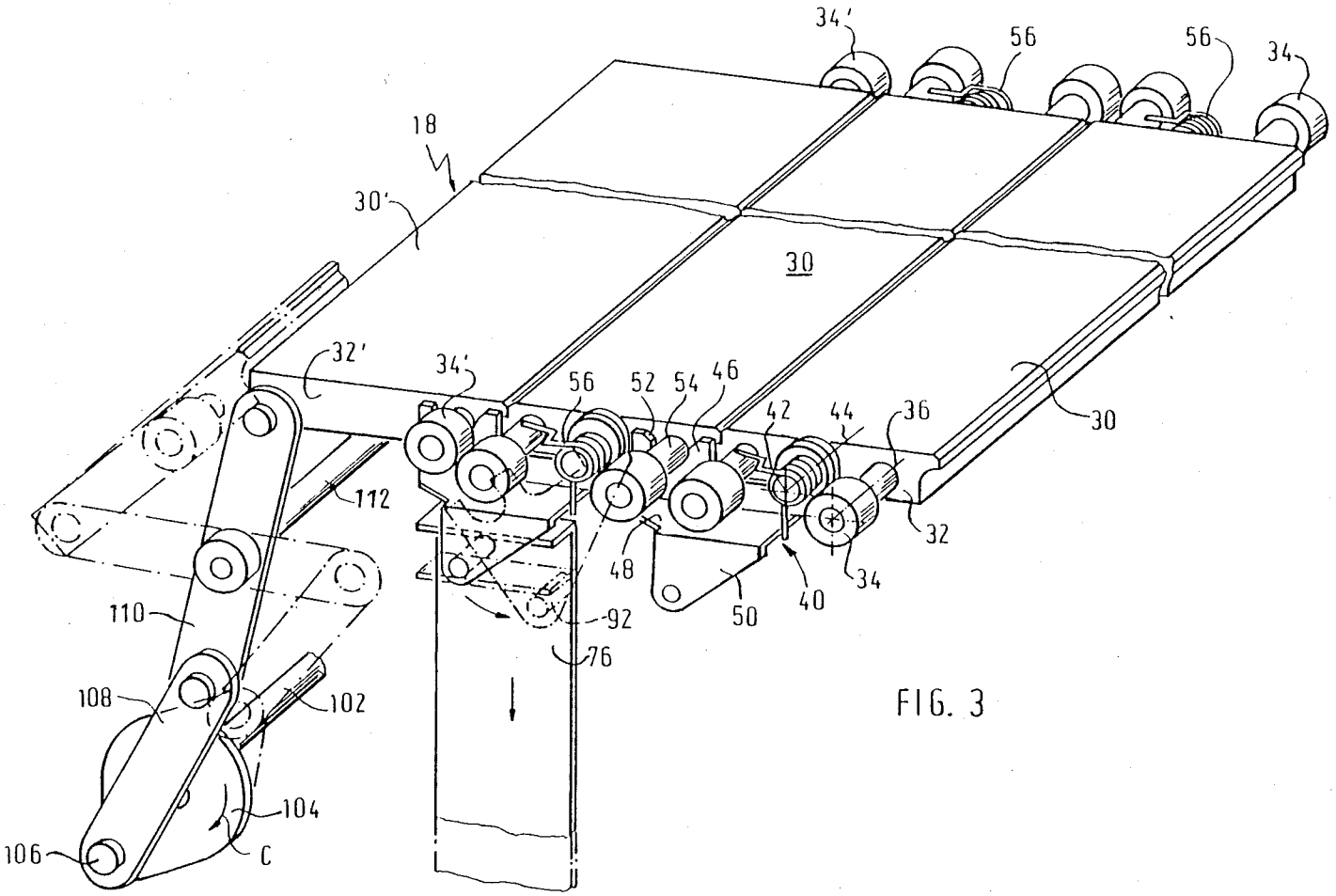
FIG. 3 shows a partly diagrammatic perspective view of a segment of the jalousie according to the invention with a drive and control mechanism.

According to FIG. 3 the jalousie consists of individual plates 30 which can be joined together along their lengthwise edges while partly overlapping one another. Each plate 30 carries rollers 34 on its end face 32 which are supported freely rotatably around an axis 36 parallel to the lengthwise direction of the plates and are spaced apart from the respective end face 32. The plates are guided by the rollers in C-shaped rails 38 which are fastened onto the container frame 28 along the lengthwise edges of the housing opening 16 (FIG. 2).

Figure 4:
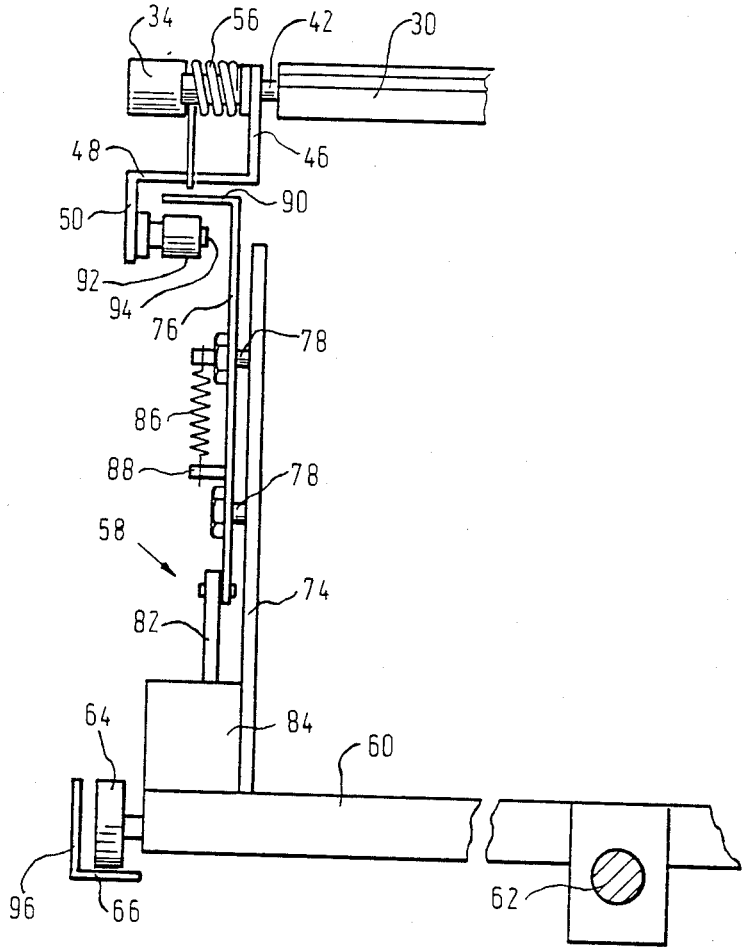
FIG. 4 shows a partly diagrammatic partial view of the control mechanism in the direction of the arrow A in FIG. 2.

A connecting element, designated in general as 40, is pivoted at the end face 32 of each plate 30 on a pin 42 around an axis of rotation 44 parallel to the lengthwise direction of the plates, between the two rollers 34. The connecting element 40 has a Z-shaped section (see FIG. 4) with a first leg 46 turned parallel to the end side 32 of the plate 30, a leg 48 standing out perpendicularly to this and a third leg 50 adjacent to this which is parallel to the first leg 46 but turned toward the opposite side. The first leg 46 is in the form of a hook swingable around the axis 44 with a hook opening 52 which is intended for grasping the pivot pin 54 of the roller 34 of an adjacent plate 30, as is represented in FIG. 3. The connecting element here is under initial stress in the connecting or locking position represented in FIG. 3 for the right connecting element. From this locking position the respective connecting element 40 can be swung against the restoring force of the torsion spring 56 into the unblocking position shown in FIG. 3 by dot-dash lines, in which the pin 54 becomes disengaged from the hook opening 52, so that the plates 30 adjacent to one another and formerly joined together by the connecting element 40 are now uncoupled. The control mechanism designated in general as 58 and serving for uncoupling the plates will now be described in particular in the following on the basis of FIGS. 2 and 4.

The control mechanism includes a carriage 60 which extends in the lengthwise direction of the plates and transversely over the container's width and is guided movably on a guide bar 62 running perpendicularly to the lengthwise direction of the plates. Moreover the carriage 60 is supported at each of its two lengthwise ends on a supporting rail 66 by means of a roller 64. An electric motor 68 which can be driven in both directions serves for driving the carriage, which motor by means of toothed belts 70 and 72 can move the carriage along the guide bars 62 and thus perpendicularly to the lengthwise direction of the plates.

The carriage carries on each of its two lengthwise ends an upright 74 running vertically on which the control lever 76 is guided movably in a straight line perpendicularly to the plane of the jalousie 18. The guiding is done by two pins 78 which pass through corresponding oblong holes 80 in the control lever 76. At its lower end the control lever 76 is connected with the armature 82 of an electromagnet 84, so that the operating lever 76 is pulled downward when a current is applied to the electromagnet 84. A restoring spring 86 which on the one hand acts on the upper pin 78 and on the other hand acts on a lug 88 of the control lever 76 pulls this back up into its starting position when the electromagnet 84 is switched off. The control lever 76 at its upper end shows a catch made in the form of a claw 90 bent at a right angle, which catch grasps a roller 92 which is pivoted on one leg 50 of the connecting element 40 around a pivot 94 parallel to the lengthwise direction of the plate. If the control lever 76 is moved downward by the electromagnet 84, the catch 90 presses on the roller 92, and thereby the connecting element 40 swings around the axis 44 and thereby the connection between two adjacent plates 30 is released. The two positions of the control lever 76 and the corresponding positions of the connecting element 40 are represented in FIG. 3 by solid or dot-dash lines.

To release the union between two selected adjacent plates 30, therefore, it is sufficient to move the control mechanism 58 along the guide bar 62 into the desired position under the plates selected, so that the catch 90 grasps the roller 92 of the related connecting element 40. After this the electromagnet 84 is actuated. In order to bring the control mechanism 58 into the desired position, a coded ruler 96 is provided which shows coding openings, not represented, corresponding to the possible positions of the carriage 60 and which can be scanned by an optoelectronic scanning device. The moving of the operating lever 76 can also be done by other means, e.g. a motor and a suitable drive.

Figure 5:
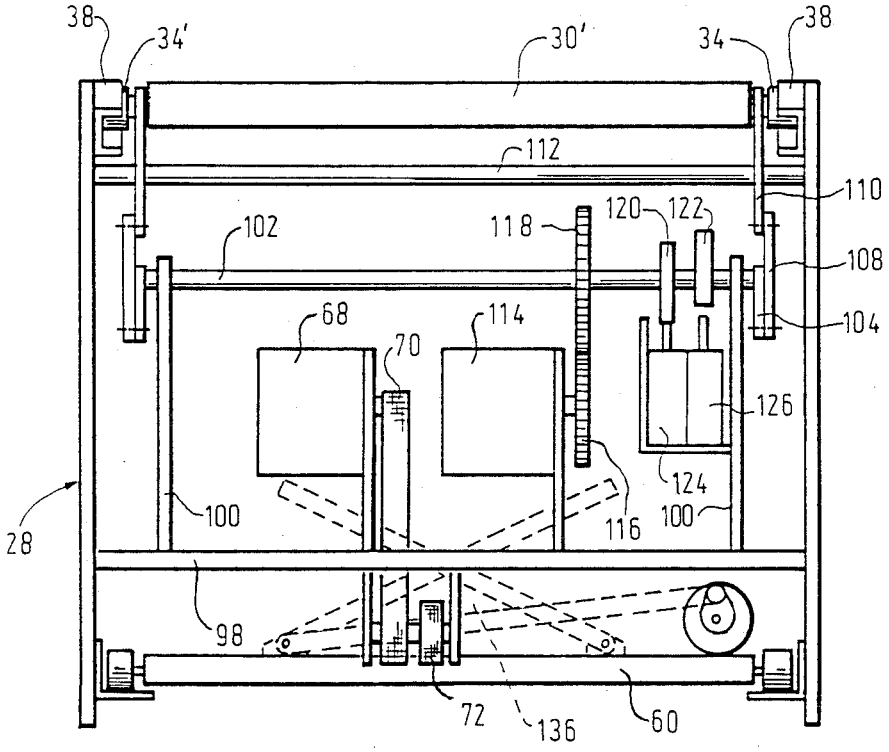
FIG. 5 shows a partly diagrammatic end view of the container's frame with the drive mechanism for the jalousie in the viewing direction shown in FIG. 2 by the arrow B.

Then, in order to unblock access to the selected compartment 22, after the release of the union between two plates 30 adjacent to one another, one of the connected jalousie segments must be pushed by one compartment width. This purpose is served by a drive mechanism acting on an end plate 30' which will now be discussed in more detail on the basis of FIGS. 3 and 5.

A spindle 102 pointed in the lengthwise direction of the plates is supported on a cross piece 98 of the container frame 28 with the use of uprights 100. This spindle carries one crank disk or eccentric disk 104 at each of its two ends, which disk is connected in a hinged manner with one end of a two-armed lever 110 by means of a double link 108 hinged onto an eccentric pin 106 of the crank disk 104. The lever is pivoted around a spindle 112 parallel to the spindle 102 and is hinged by its other end to the end face 32' of the end plate 30'.

The spindle 102 is driven by an electric motor 114 the drive pinion 116 of which meshes with a gear 118 arranged rotationally integral on the spindle 102. Moreover, two disk cams 120 and 122 are arranged rotationally integral on the spindle 102, which disk cams interact with two switches 124, 126 integral with the frame, which switches control the switching on and off of the motor 114.

If the crank disk 104 is rotated in the direction of the arrow C in FIG. 3 by switching on the motor 114, after the releasing of the union between two adjacent plates 30, then the two-armed lever 110 is swung out of the position represented in solid lines in FIG. 3 into the position represented in dot-dash lines, wherewith the end plate 30' and the other plates 30 still joined with it are shifted to the left in FIG. 3. The end plate 30' here with its guide rollers 34' is guided in a bent segment 38' of the guide rail 38, so that the end plate 30' can follow the swinging motion of the two-armed lever 110. The lever lengths and the crank radius of the crank disk 104 are chosen such that with a rotation of 180° of the crank disk 104, the end plate 30' and the other plates 30 connected with it are shifted by exactly the width of one compartment. This shifting path always remains the same regardless of which position of the jalousie it is at which the union between the plates 30 is broken and a compartment opening is to be unblocked.

If the crank disk 104 is rotated further in the direction of the arrow C and out of the position reproduced by dot-dash lines in FIG. 3, then the two-armed lever 110 is again swung in the opposite direction and pushes the end plate 30' together with the plates adjacent to it back into the starting position. This forced movement of the end plate 30' is facilitated by the oblique ramp on the lowered rail segment 38'. The oblique ramp also causes the end plate 30' to be lowered somewhat when the jalousie is opened, and in this way any unintentional uncoupling of the adjacent plate 30 is prevented. When the two plates 30 between which their union was released are against each other again, the electromagnet 84 is switched off, whereupon the connecting element 40 is returned by the restoring spring 56 to its starting position in which it grasps the respective pin 54 on the adjacent plate. If necessary, the arrangement can be made such that the electromagnet 84 is switched off after the unblocking of the compartment opening, whereby the connecting element 40 returns to its rest position. In this case the connecting element 40 is to be provided with guide surfaces, so that the pin 54 of the adjacent plate automatically catches in the hook opening 52 when the two jalousie segments are moved together.

The lifter device will now be described in detail on the basis of FIG. 6. In the partly diagrammatic FIG. 6, the control mechanism 58 which was already described in detail on the basis of FIG. 4 has now been omitted.

Figure 6:
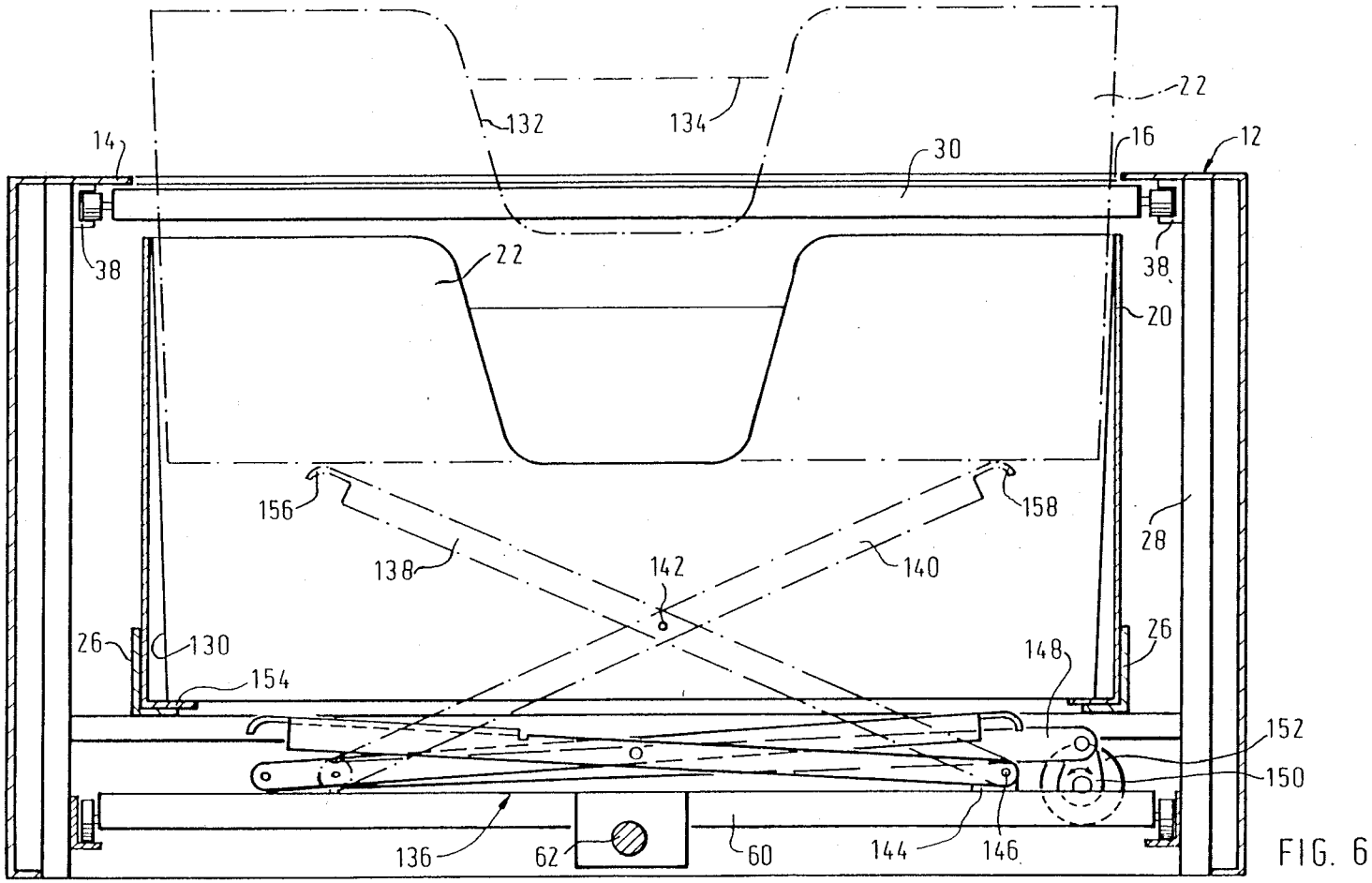
FIG. 6 shows a partly diagrammatic section through the container according to the invention in a section plane running between two compartment receptacles.

In FIG. 6 is seen the unit 20 resting on the V guides 26, in which unit the compartment receptacles 22 are arranged. The compartment receptacles 22 show an essentially flat rectangular shape and lie with their side walls 128 immediately adjacent to one another.

The narrow end walls 130 run downward toward one another, which facilitates the sliding of the compartment receptacles 22 into the case 20 from the position reproduced in dot-dash lines in FIG. 6 into the position reproduced by solid lines. In their upper half the side walls 128 each show a cutaway portion 132 which facilitates the removal of rails 134 from the compartment receptacle 22.

The lifting of the compartment receptacle is done by means of a lifter device designated in general as 136, which is arranged on the carriage 60 and thus is movable together with the control mechanism 58 by means of the servomotor 68 and the toothed belts 70 and 72 along the guide bar 62. The lifter device 136 includes lifter scissors with two scissor arms 138 and 140 which are joined hinged with one another around a pivot 142 turned parallel to the guide bar 62. The one swinging arm 138 is hinged swingably by its one end on a strip 144 firmly joined to the carriage 60 around a pivot 146. The other scissor arm 140 is conencted by its one end by way of a double link 148 with a crank disk 150 which can be moved to and fro by an electric motor 152 in the direction of the double headed arrow. It is seen from FIG. 6 that when the crank disk 150 is rotated by 90° in either direction, the scissor arms 138 and 140 can be moved between the flat position reproduced in FIG. 6 by solid lines and a lifted position reproduced by dot-dash lines. Since the case 20 shows no bottom, but rather the compartment receptacles 22 are merely seated on frame tracks 154 of the chest 20, when the scissor arms 138 and 140 are swung up to their lifted position they press against the bottom of the respective compartment receptacle 22 and lift this through the respective slot-like opening unblocked by the jalousie 18 and up out of the container 10 into the position shown by the dot-dash lines. In order to facilitate the sliding of the scissor arms 138 and 140 on the bottom of the respective compartment receptacle 22, the scissor arms 138 and 140 made of sheet metal sections are bent at their free end to form a sliding surface 156 and 158 as is represented in FIG. 6.

As is seen from FIG. 2, the arrangement of the lifter device 136 and of the control mechanism 58 on the carriage 60 is done in such a way that after the positioning of the carriage 60 relative to a particular compartment receptacle 22, the control lever 76 grasps the roller 92 of the connecting element 40 when the scissor arms 138 and 140 come into position under the bottom of the compartment receptacle 22. The carriage drive 68, 70, 72, the electromagnet 84 and the servomotor 152 are coupled together and electronically controllable in such a way that upon a suitable control signal generated by the user, the carriage 60 is first positioned relative to the chosen compartment receptacle 22 and then the jalousie 18 is opened in the manner described above, and finally the receptacle 22 is lifted. After the removal or putting in of bills 134, then after the dropping of the lifting shears 138, 140, the respective compartment receptacle 22 returns into the case 20 by reason of gravity, whereupon the jalousie is closed again in the manner described above.

The container described above is particularly suitable for keeping foreign currency at a bank counter. When the jalousie is closed the currency is in secure custody. Even after the opening of the jalousie by one compartment width, it is still difficult to reach into the unblocked compartment. Only by lifting the receptacle 22 out of the container 10 does access to the bills 134 contained in the compartment receptacle become conveniently possible. Then access to the other compartments 22 is blocked at the same time, since the unblocked opening is practically completely closed off by the lifted-up compartment receptacle 22. Thus access to one compartment is possible to a maximum degree.

In order to restrict any possibilities of manipulation in pushing in and taking out the case 20 in or out of the container 10, the case 20 has a cover 160 assigned to it which is lockable with the case 20 in a manner not represented. Without a special key or the like, the locking can only be released when the case is completely inside the container 10. On the other hand the case 20 can be removed from the container 10 only when the cover 160 is locked to the case 20.

The invention has been described above on the basis of a container for bills or the like. It is understood that the container and the jalousie closure can find use wherever only a partial opening of an opening which as a whole can be closed off by the jalousie is to be unblocked, as for example in automatic merchandise dispensers and the like. The connecting elements and the control mechanism have been represented and described on only one side of the jalousie and the container. It is understood that the connecting elements can be arranged on both end faces of the plates, as is seen as an indication in FIG. 3. Accordingly a control mechanism 58 must also be provided on the other jalousie side.

We claim:

1. Apparatus for selectively accessing any of a plurality of receptacles within a normally closed housing comprising:

a housing;

means within said housing defining a plurality of substantially similar, open receptacles, said receptacles being arranged in side-by-side parallel relationship with the openings similarly oriented;

a plurality of plate elements substantially overlying the openings of said receptacles and in side-by-side parallel relationship so as to normally prevent access to said receptacles;

support means for permitting said plate elements to translate relative to said housing by a distance substantially equal to the width of a receptacle opening;

a plurality of releasable union means interlocking each plate element within an adjacent plate element when said plate elements overlie said receptacles;

selectively operable means disposed within said housing for releasing one of said union means to permit at least the plate elements on one side of said one union means to be displaced relative to the plate elements on the other side of said union means to provide an access opening between plate elements to a given receptacle; and a drive mechanism disposed within said housing for displacing said plate elements on said one side of said one union means to provide said access opening, said drive mechanism being connected with and acting on an end one of said plate elements on said one side of said union means.

2. Apparatus as claimed in claim 1, further including positioning means for raising the receptacle immediately under the access opening so that the raised receptacle protrudes at least partly through the access opening.

3. Apparatus as claimed in claim 2, wherein said receptacles are of box-like construction and taper toward the bottom.

4. Apparatus as claimed in claim 2 characterized in that the positioning means is arranged on a carriage (60) which can be moved in the housing (12) relative to the receptacles (22) by means of a positioning drive (68, 70, 72, 96).

5. Apparatus as claimed in claim 2 wherein the positioning means comprises a lifter scissors with two crossed scissor arms (138,140) which are hinged onto each other and which by their free ends are intended to be supported in a sliding manner on the bottom of a receptacle (22).

6. Apparatus as claimed in claim 1 characterized in that the receptacles are arranged in a case which can be removed from the housing.

7. Apparatus as claimed in claim 1, wherein each of the plate elements (30,30') is mounted on at least one roller (34,34') and each of the rollers is guided in a track (38) of said support means.

8. Apparatus as claimed in claim 1 characterized in that on each plate (30) with the exception of the end plate (30') said union means comprises at least one hook-shaped connecting element (40) arranged in swingable form, which comes into contact with a counter-element (54) formed on the respective adjacent plate (30) and can be swung into its unblocking position by mechanism (58) said selectively operable means.

9. Apparatus as claimed in claim 8, characterized in that the connecting element (40) in its contact position is under initial stress by a restoring spring (56).

10. Apparatus as claimed in claim 8 characterized in that the hook-shaped connecting elements (40) are pivoted on the end faces (32) of the plates (30) around axes parallel to the lengthwise direction of the plates and that the counter-element (54) is respectively formed by a pin, preferably a spindle of a roller (34).

11. Apparatus as claimed in claim 8 characterized in that said selectively operable means is movable perpendicularly to the lengthwise direction of the plates and parallel to the plane of the plate elements and includes at least one control lever (76) for swinging the connecting element (40) into its unblocking position.

12. Apparatus as claimed in claim 11, characterized in that the control lever (76) can be moved into its working position by an electromagnet (84) against the action of a restoring spring (86).

13. Apparatus as claimed in claim 11 characterized in that the control lever (76) is supported on a movable carriage (60) so as to be movable in a straight line substantially perpendicularly to the moving direction of the carriage and perpendicularly to the lengthwise direction of the plates and at its free end includes a catch (90) which in the working position of the control level (76) grasps an extension (92) on the connecting element (40).

14. Apparatus as claimed in claim 13, characterized in that said drive mechanism acting on said one end plate element (30') includes a crank (104) pivoted around a first stationary spindle (102) and drivable by a servomotor (114), as well as a two-armed lever (110) which is pivoted around a second stationary spindle (112) and is hinged by its one end on the end plate (30') and by its other end is connected by way of a double link (108) to the crank (104), where the end plate (30') is guided by a curved rail (38') of said support means, the curved rail fitting the motion of the two-armed lever (110).

15. Apparatus as claimed in claim 14, characterized in that the servomotor (114) is controlled in such a way that the crank (104) executes one half rotation each for the opening and closing motion of the plate elements.

16. Apparatus as claimed in claim 15, characterized in that at least one disk cam (120, 122) is arranged on said first spindle (102) and fixed for rotation with the crank (104) so as to be rotatable by the servomotor (114), which disk interacts with a switch (124, 126) for controlling the servomotor (114).

* * * * *